US009346591B2

(12) United States Patent
Martinengo

(10) Patent No.: US 9,346,591 B2
(45) Date of Patent: May 24, 2016

(54) SCREW CAP CLOSURE

(71) Applicant: AMCOR FLEXIBLES CAPSULES FRANCE, La Defense (FR)

(72) Inventor: Hervé Martinengo, Sainte-Colombe (FR)

(73) Assignee: AMCOR FLEXIBLES CAPSULES FRANCE (FR)

( * ) Notice: Subject to any disclaimer, the term of this patent is extended or adjusted under 35 U.S.C. 154(b) by 0 days.

(21) Appl. No.: 14/505,225

(22) Filed: Oct. 2, 2014

(65) Prior Publication Data

US 2015/0158622 A1 Jun. 11, 2015

Related U.S. Application Data

(63) Continuation of application No. 14/116,673, filed as application No. PCT/EP2012/001879 on May 2, 2012, now abandoned.

(30) Foreign Application Priority Data

May 9, 2011 (EP) ..... 11354018

(51) Int. Cl.

| | |
|---|---|
| ***B65B 7/28*** | (2006.01) |
| ***B65D 41/04*** | (2006.01) |
| ***B65D 41/62*** | (2006.01) |
| ***B65D 41/17*** | (2006.01) |

(52) U.S. Cl.

CPC ..... *B65D 41/62* (2013.01); *B65D 41/17* (2013.01)

(58) Field of Classification Search

USPC ..... 215/21, 44, 329, 272, 324; 53/485

See application file for complete search history.

(56) References Cited

U.S. PATENT DOCUMENTS

| | | | | |
|---|---|---|---|---|
| 4,546,892 | A | 10/1985 | Couput | |
| 6,050,436 | A * | 4/2000 | Bennett | B65D 41/3428 215/251 |
| 6,403,173 | B1 | 6/2002 | Granger et al. | |

(Continued)

FOREIGN PATENT DOCUMENTS

| | | | |
|---|---|---|---|
| FR | 2 870 826 | A1 | 12/2005 |
| GB | 2 418 910 | A | 4/2006 |

(Continued)

OTHER PUBLICATIONS

International Search Report issued for international Application No. PCT/EP2012/001879 mailed Jun. 6, 2012.

(Continued)

*Primary Examiner* — Shawn M Braden

(74) *Attorney, Agent, or Firm* — RatnerPrestia

(57) ABSTRACT

Composite cap intended to be snapped on the glass ring of a bottle and then to serve as a stopper that can screwed and unscrewed as required, the glass ring being provided with at least one annular bead. It comprises a shell with a skirt provided with an internal annular bead; a first insert, disposed inside said shell, provided with an internal screw thread, characterized in that it also comprises a second insert having at least two roughly cylindrical portions; the first portion being provided on its external wall with a screw thread complementary to that of said first insert, the second portion being provided with axial immobilization means intended to cooperate with said annular bead and axial stop means, cooperating with said internal annular bead, so that the inserts secured together by screwing are trapped inside said shell.

13 Claims, 1 Drawing Sheet

(56) References Cited

U.S. PATENT DOCUMENTS

| | | | | |
|---|---|---|---|---|
| 6,619,492 | B2 * | 9/2003 | Battegazzore | B65D 49/04 215/21 |
| 7,124,905 | B2 | 10/2006 | Granger et al. | |
| 7,398,890 | B2 * | 7/2008 | Thomson | B65D 49/04 215/21 |
| 7,922,018 | B2 | 4/2011 | Granger et al. | |
| 2004/0232101 | A1 * | 11/2004 | Gardner | B65D 1/0246 215/277 |
| 2010/0018940 | A1 | 1/2010 | Granger | |

FOREIGN PATENT DOCUMENTS

| | | | |
|---|---|---|---|
| WO | WO 2007/138191 | A2 | 12/2007 |
| WO | 2008084143 | | 7/2008 |

OTHER PUBLICATIONS

New Zealand First Examination Report mailed Aug. 14, 2015 for Application No. 617556.

* cited by examiner

SCREW CAP CLOSURE

CROSS-REFERENCE TO RELATED APPLICATIONS

This application is a continuation application of U.S. application Ser. No. 14/116,673, filed Nov. 8, 2013, which is a U.S. National Phase application of International application number PCT/EP2012/001879, May 2, 2012, which claims priority from European application number 11354018.1, filed May 9, 2011, each of which is incorporated herein by reference in its entirety for all purposes

FIELD OF THE INVENTION

The invention concerns the field of caps and more especially screw caps intended to close receptacles, in particular glass bottles. The bottles concerned contain in particular drinks, typically alcoholic drinks, such as wines, aperitifs, liqueurs or alcohols, the consumption of which is typically staged, which requires being able to close and open said bottles, possible a large number of times.

BACKGROUND OF THE INVENTION

A large number of caps are already known. Some of these caps are made from plastics material, as described in European patent EP 0 107 680. They are typically intended for closing plastic water bottles. Others, intended in particular for closing alcohol, aperitif and spirits bottles, such as the one described in the French patent application FR 2 763 046, comprise an insert made from plastics material, comprising an internal screw thread suited to the standard screw thread of collars of glass bottles and fixed to the inside of a metal shell, the cylindrical skirt of which reveals no visible screw thread.

The patent EP 1 254 059 describes a cap suitable for closing wine bottles, also without any visible thread. It comprises a cap blank, typically a metal shell provided with a head and a skirt, and an insert made from plastics material fixed to said blank and having a particularly thin skirt also comprising an internal screw thread suited to the standard screw thread of collars of glass bottles. This composite cap is supplied to the bottlers who, after filling the bottle, have to screw the assembly onto the glass collar of the bottle and then crimp the metal shell by effecting a restraint below the bead.

Such a solution does not appear to be completely satisfactory since the composite cap, as supplied to the bottlers, requires, after the filling of the content of the bottle and the placing of the cap on the glass ring, additional operations, such as screwing and crimping, which require the use of rotary tools which are not easy to move on a continuous-kinematics line, and which consequently reduce throughputs and make the bottling process more expensive.

The applicant has therefore attempted to find a satisfactory solution for supplying to bottlers a capping product that is at least as effective with regard to reversible stoppering and able to offer controlled sealing conditions and that does not require as many operations after filling of the bottle.

SUMMARY OF THE INVENTION

A first subject matter according to the invention is a composite cap intended to be fixed to the glass ring of a bottle and then to serve as a stopper that can be screwed and unscrewed as required in order to close or release the dispensing orifice of said bottle, said glass ring being provided with at least one annular bead and said composite cap comprising:

- a shell, typically metal, with a substantially cylindrical skirt, provided with an internal annular bead;
- a first insert, disposed inside said shell, secured to said shell, comprising a skirt provided with an internal screw thread, characterised in that it also comprises a second insert, roughly in the form of a sleeve having at least two roughly cylindrical portions;

- the first portion being provided on its external wall with a screw thread complementary to that of said first insert, so that said first insert and said second insert are an assembly secured together by screwing, situated inside said shell;
- the second portion being provided with axial immobilisation means intended to cooperate with said annular bead on said glass ring and axial stop means, typically the bottom end of said second portion, cooperating with said internal annular bead on said shell, so that said assembly secured together by screwing is trapped inside said shell.

The cap according to one aspect of the invention comprises two inserts:

- a first insert fulfilling the role described for example in EP 1 254 059: it makes the cap screwable and unscrewable after first opening while not revealing any external screw thread;
- a second insert, which is assembled on the first insert by screwing, so that the assembly thus formed can be introduced into the shell and trapped therein, by virtue of the internal annular bead on said shell. Said internal annular bead corresponds typically, when the shell is metal, to the internal part of an annular groove produced by external application of a knurling tool on the cylindrical skirt.

Thus formed, the composite cap, provided with means of immobilisation with respect to the glass ring, can be simply pressed onto the neck of the bottle until said immobilisation means irreversibly secure the cap on the neck.

These immobilisation means comprise axial immobilisation means that act so that, when said composite cap is pressed by simple translation on said neck, a bead on the glass ring is trapped at the middle of said immobilisation means. Advantageously, these immobilisation means also comprise circumferential immobilisation means (immobilisation with respect to rotation) so that, after first opening, said second insert, completely secured to the glass ring, serves as an attached screw thread. The circumferential immobilisation means are for example longitudinal ribs that extend on the internal wall of the first portion and/or the second portion of the second insert and cooperate with reliefs provided on the external surface of the glass ring placed so that they serve as a stop for said ribs in rotation in both directions.

By convention, we describe the various parts of the cap by assuming that it is placed (or ready to be placed) on the glass ring of an upright bottle. Thus the terms "upper", "above", etc. mean simply that the objects thus designated are closer to the dispensing orifice whereas the terms "lower", "below", etc. means simply that the objects thus designated are further away from the dispensing orifice of the bottle. Following this convention, the first insert is "above" the second insert, the first portion of which is an "upper" portion screwed into the first insert.

Advantageously, the cylindrical skirt of the shell has a circumferential easy-rupture line, situated below the first insert, close to the lower end of the skirt thereof, and preferably above the second portion of the second insert, so that the immobilisation means and the annular bead on the glass ring remain concealed even after the first opening. At the time of the first opening, the top of the shell, which is secured to the first insert, is driven in rotation whereas the second insert remains locked with respect to rotation and is held axially while remaining secured to the bottom of the shell. By accentuating the rotation in the direction of unscrewing, the shell tears at the easy-rupture line and the composite capsule is transformed into two separable parts: an upper part serving as a screwable and unscrewable cap and a lower part serving as a screw thread attached to the neck of the bottle.

Advantageously, the first insert and the second insert have external walls the diameter of which are substantially similar so that the assembly secured by screwing has a cylindrical appearance overall, with an outside diameter preferably substantially equal to the inside diameter of the shell skirt. Advantageously, the transition between the first portion and the second portion of the second insert comprises a shoulder that extends typically as far as said outside diameter and serves as a stop for the screwing of the second insert in the first insert.

Advantageously, the glass ring comprises a second annular bead intended to serve as an axial stop for the internal annular bead on the shell not only when the composite cap is pressed on the neck of the bottle but also after tearing of the easy rupture line: the bottom part of the shell can thus remain at its original location whatever the friction conditions at the interface of the bottom part of the shell and the external cylindrical wall of the second portion of the second insert. The risk that it may "fall" as far as the bottom of the neck of the bottle, revealing the means of immobilisation of the bead and the second insert, is thus prevented.

Advantageously, said composite cap also comprises an attached seal. For example, the first insert comprises a head that extends transversely to said skirt and said attached seal is placed inside the first insert, having a diameter such that it remains trapped between said head and the upper end of the first portion of the second insert.

Preferably, said first portion of the second insert has a height such that, when said composite cap is irreversibly secured to said glass ring, its upper end is situated below the level of the rim of the ring, also referred to as the "ring top". In this way, when said composite cap is placed on the glass ring, an annular bearing zone, close to the periphery of said seal, comes into contact with the top of the ring and, after irreversible securing of the composite cap on the neck, said annular bearing zone is compressed between the head of the insert and said ring top.

Advantageously, said seal comprises a resilient layer. It is typically a layer made from an expanded polymeric material such as expanded polyethylene, the thickness of which is greater than 1 mm. Preferably, this layer is thicker than the resilient layer of the seals used in conventional caps: under the normal geometric conditions of the bottles concerned (dispensing orifice with a diameter typically between 18 and 25 mm), it is greater than 2 mm, or even greater than or equal to 2.5 mm. By virtue of this particular thickness, said resilient layer can, apart from its specific function in a seal, fulfil two other functions associated firstly with the spring effect that it can exert at the end of pressing on when the composite cap is fixed on the glass ring (see [0020]) and secondly with its suitability for compensating for the axial plays due to the addition of the separations found between the actual dimensions of the manufactured parts and their nominal values. This thick resilient layer may in fact fulfil a beneficial role in the compensation for the total of the axial dimensional plays related to the conditions of manufacture of the glass ring and those related to the manufacturing conditions of the various parts of the composite cap.

Advantageously, said first insert has radial compression means, as described in the patent EP 1 638 853, which, without the formation of a fold, presses the periphery of said seal on the periphery of the upper end of the glass ring, the latter including the peripheral edge of the rim and a substantially cylindrical portion of the ring.

The applicant has also found that, when the first portion of the second insert has an upper end below the level of the top of the ring, and when it is provided with an attached seal as described above and coming into abutment directly on the top of the ring, the composite cap according to the invention guarantees a seal superior to those of other systems clipped onto a glass ring, because the seal bears directly on the glass rim rather than on a plastic part, which confers on it better reliability over time.

The cap according to the invention is intended to be mounted on a specific glass ring, with no screw thread but having at least one axial immobilisation means, such as an annular bead, continuous or not, intended to cooperate with the axial immobilisation means of the second insert, and circumferential immobilisation means intended to cooperate with those of the second insert in order to lock the latter with respect to rotation. The design of the various elements of the composite cap must be adapted to a realistic geometry of the neck of the bottle. In particular, the dimensions of said second insert must be defined so that the dimensional tolerances in industrial manufacture of said second insert are compatible with the dimensional tolerances in industrial manufacture of said glass ring.

In a preferred embodiment, the second portion of the second insert comprises a lower end annulus and an upper end annulus connected together by longitudinal bridges. Between these longitudinal bridges there extend flexible annular blades attached to said lower end annulus, oriented upwards and, at rest, inclined towards the longitudinal axis, so that the ends of said blades are situated on a circle the diameter of which is less than the outside diameter of the annular bead on the glass ring. When the composite cap is pressed on the neck, said flexible blades flex towards the outside when they come into contact with said annular bead on the glass ring and then return abruptly to their position at rest when they have gone beyond said bead, which prevents any withdrawal movement, that is to say any movement in the direction opposite to the pressing on of the cap, the ends of said flexible blades being situated almost immediately in abutment against said annular bead.

Said upper end annulus is advantageously provided with a lower wall that forms a shoulder while extending as far as a diameter less than that of the annular bead on the glass ring. This lower wall completes the trapping of said bead by preventing the continuation of the pressing of said cap on said ring.

The resilient layer of the seal can be used to effect a pressing on beyond the theoretical dimension corresponding to the release of the ends of the flexible blades. This additional pressing on, typically of around 0.5 mm, makes it possible, because of the manufacturing dimensional tolerances of the glass ring and the various parts of the composite cap, to be sure that the flexible blades will indeed release at the end of pressing on, that is to say their ends are actually situated on a circle with a diameter substantially less than that of the annular bead on the ring. When the pressing-on force is stopped, the spring effect of the resilient layer drives the whole of the composite cap upwards and the ends of the flexible blades arrive in abutment against said annular bead.

Advantageously, said glass ring comprises a second annular bead also serving as a stop for the pressing on when it cooperates with the internal annular bead on the shell.

The major advantage of the invention lies in the fact that, after filling of the bottle, it is no longer necessary to screw the composite cap on the ring and then crimp it: it suffices to press it onto the neck until it is trapped. The simplicity of this movement makes it possible to increase production rates with bottling machines functioning in simplified continuous kinematics.

Another subject matter of the invention is a glass ring occupying the top of the neck of a bottle and intended to accept a composite cap according to the invention, characterised in that it comprises an annular bead situated at a distance from the top rim but level with said first portion of said second insert as well as circumferential immobilisation means cooperating with the circumferential immobilisation means of said second insert. It is a case for example of reliefs cooperating with longitudinal internal ribs attached to the internal wall of said second insert.

The glass ring according to the invention is associated with the composite cap according to the invention. This is a novel glass ring, different from those used in the prior art (cf. FR 2 763 046 and EP 1 254 059 for example), since it is devoid of any screw thread but comprises a special annular bead and circumferential immobilisation means the position and dimensions of which are specifically adapted to said composite cap, so that said second insert, once fixed on said glass ring after snapping on by simple pressing of said composite cap onto said glass ring, becomes an attached screw thread perfectly secured to said glass ring.

Advantageously said glass ring comprises a second annular bead serving as a stop for the pressing on of said composite cap.

Another subject matter of the invention is a bottle intended for the staged consumption of wines, aperitifs, liqueurs, alcohols or alcoholic drinks, characterised in that its neck is provided with a glass ring according to the invention and in that it is provided with a composite cap according to the invention.

Another subject matter of the invention is a method for capping a bottle intended for the staged consumption of wines, aperitifs, liqueurs, alcohols or alcoholic drinks, characterised in that a) bottles provided with a glass ring according to the invention are obtained;
b) they are filled with the liquid that said bottles are to contain;
c) composite caps according to the invention are obtained and are fixed to the glass ring of said bottles by simple axial translation.

PARTICULAR EMBODIMENTS OF THE INVENTION

Figure 1:
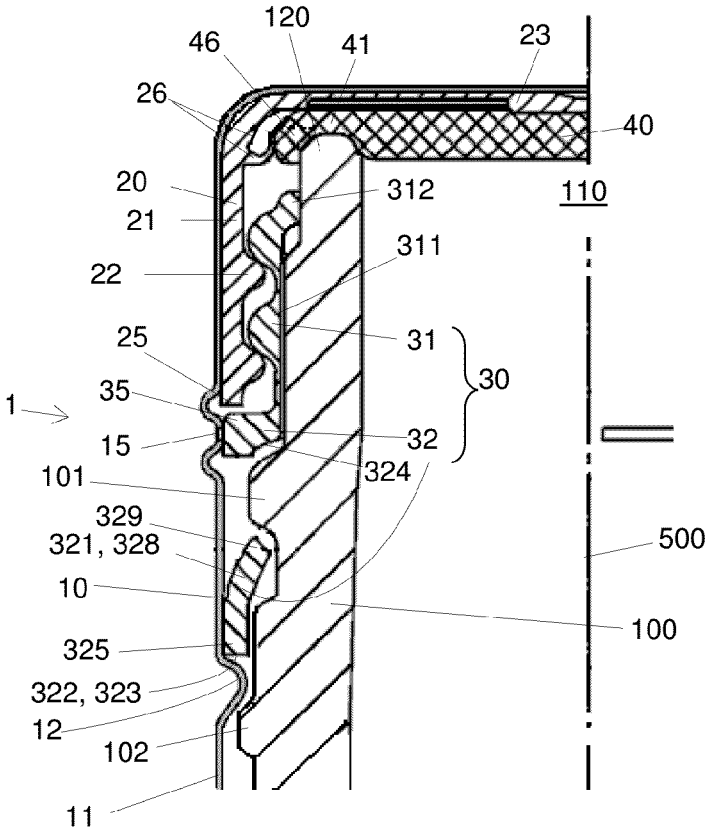
FIG. 1 illustrates in diametral half-section the upper end of a bottle capped with a particular embodiment of the invention.
Figure 2:
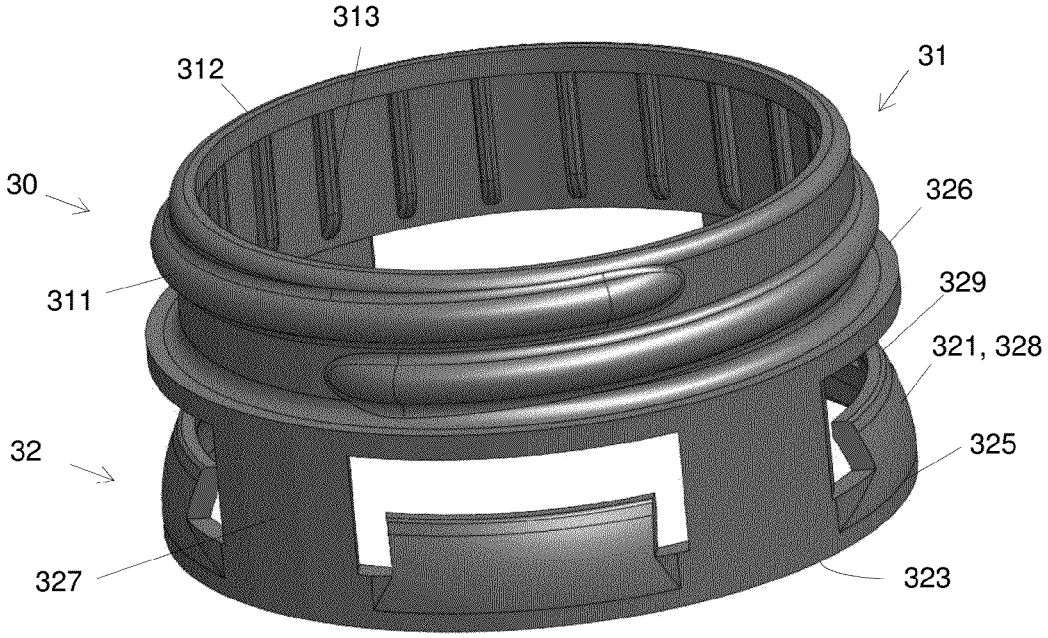
FIG. 2 illustrates in perspective the second insert of the composite cap shown in FIG. 1.

FIGS. 1 and 2 below illustrate a preferred embodiment of the invention, dedicated to the stoppering of wine bottles.

The composite cap (1) comprises a metal shell (10) having a cylindrical skirt (11) provided with an internal annular bead (12). It also comprises two inserts (20 and 30) screwed together and introduced inside the shell (10).

The first insert (20) makes the cap screwable and unscrewable after first opening while not revealing any external screw thread. The second insert (30) is assembled on the first insert by screwing, so that the assembly thus formed can be introduced into the shell and then trapped therein by means of the internal annular bead (12). The internal annular bead (12) corresponds to the internal part of an annular groove produced by external application of a knurling tool to the cylindrical skirt.

The second insert (30) has two roughly cylindrical portions: a first portion (31) provided on its external wall with a screw thread (311) complementary to that of said first insert, and a second portion (32) provided with axial immobilisation means (321) intended to cooperate with the annular bead (101) on the glass rim (100). The lower end (323) of the second portion (32) cooperates with the internal annular bead (12) on the shell (10), so that the set of screwed inserts (20+30) is trapped inside the shell.

The second portion (32) of the second insert (30) comprises a lower end annulus (325) and an upper end annulus (326) connected together by longitudinal bridges (327). Between these longitudinal bridges there extend flexible annular blades (328) attached to said lower end annulus, oriented upwards and, at rest, inclined towards the longitudinal axis (500), so that the ends (329) of said blades are situated on a circle the diameter of which is less than the outside diameter of the annular bead (101) of the glass ring (100).

When the composite capsule is pushed onto the neck, the flexible blades (328) flex outwards when they come into contact with the annular bead (101) on the glass ring and then return abruptly to their idle position when they have passed beyond said bead, which prevents any withdrawal movement.

The upper end annulus (326) is provide with a bottom wall (324) that forms a shoulder forming an axial stop for the annular bead (101) on the glass ring.

The second insert (30) also comprises longitudinal ribs (313) that extend on the internal wall of the first portion (31) and cooperate with reliefs formed on the external surface of the glass ring.

The cylindrical skirt (11) of the shell (10) has a circumferential easy-rupture line (15), situated below the first insert (20), close to the bottom end (25) of the skirt (21) thereof, and above the second portion (32) of the second insert (30), so that the flexible blades (328) and the annular bead (101) remain concealed even after the first opening.

The first insert (20) and the second insert (30) have substantially cylindrical external walls the diameters of which are substantially equal to the inside diameter of the skirt (11) of the shell (10). The transition between the first portion (31) and the second portion (32) of the second insert (30) comprises a shoulder (35) that serves as a stop for the screwing of the second insert in the first insert.

The composite cap also comprises an attached seal (40) placed inside the first insert (20). Its diameter is such that it remains trapped between the head (23) of the first insert and the upper end (312) of the first portion (31) of the second insert (30). When the composite cap is placed on the glass ring, an angular abutment zone (41), close to the periphery (46) of the seal (40), comes into contact with the rim (120), also referred to as the "ring top", so that, when the composite cap is pressed onto the neck after bottling, the annular abutment zone (41) is compressed between the head of the insert (23) and the rim (120).

The seal comprises a resilient layer of expanded polyethylene. In the context of this example, the thickness of the resilient layer is 2.5 mm. The first insert (20) has radial compression means, here a double flexible tongue (26), which, without the formation of a fold, press the periphery (46) of the seal (40) on the periphery of the upper end of the glass ring, the latter including the peripheral edge of the rim and a substantially cylindrical portion of the ring.

The glass ring (100) associated with said composite cap (1) has no screw thread but has a continuous annular bead (101) intended to cooperate with the flexible annular blades (328) of the second insert (32), and reliefs (not shown) intended to cooperate with the longitudinal ribs (313) of the second insert (30) in order to lock the latter with respect to rotation. The glass ring also comprises a second annular bead (102) intended to serve as an axial slot for the internal annular bead (12) on the shell.

What is claimed is:

1. A composite cap adapted to be fixed to a glass ring of a bottle having a neck and then to serve as a stopper that can be screwed and unscrewed as required in order to close or release a dispensing orifice of said bottle, said glass ring being provided with at least one annular bead, said composite cap comprising:

a shell, with a substantially cylindrical skirt, provided with an internal annular bead;

a first insert, disposed inside said shell, secured to said shell, comprising a skirt provided with an internal screw thread, wherein the composite cap also comprises a second insert, roughly in the form of a sleeve having at least two roughly cylindrical portions the first portion being provided on its external wall with a screw thread complementary to that of said first insert, so that said first insert and said second insert are an assembly secured together by screwing, situated inside said shell;

the second portion being provided with an axial immobilisation means adapted to cooperate with said annular bead on said glass ring and axial stop means, cooperating with said internal annular bead, so that said assembly secured together by screwing is trapped inside said shell;

wherein said first insert comprises a head extending transversely to said skirt of the first insert, and wherein the composite cap also comprises an attached seal, placed inside the first insert and having a diameter such that the attached seal remains trapped between said head and the upper end of said first portion and wherein said first portion of the second insert has a height such that, when said composite cap is secured irreversibly to said glass ring, the top end of the first portion of the second insert is situated below the level of the top of the glass ring, so that, when said composite cap is placed on the glass ring, an annular abutment zone, close to the periphery of said attached seal, comes into contact with the top of the glass ring and, after irreversible securing of the composite cap on the neck of the bottle, said annular abutment zone is compressed between the head of the first insert and said top of the glass ring.

2. A composite cap according to claim 1, wherein said second insert is also provided with circumferential immobilisation means cooperating with circumferential immobilisation means formed on said glass ring.

3. A composite cap according to claim 1, wherein the skirt of the first insert has a lower end and the skirt of the shell has a circumferential easy-rupture line situated below said first insert, close to the lower end of the skirt of the first insert, and above the second portion of the second insert.

4. A composite cap according to claim 1, wherein the first insert and the second insert have cylindrical external walls the diameters of which are substantially adjacent so that the assembly secured by screwing has a roughly cylindrical appearance, with an outside diameter substantially equal to the inside diameter of the skirt of said shell.

5. A composite cap according to claim 4, having a transition between the first portion and the second portion of the second insert which comprises a shoulder that serves as a stop for the screwing of said second insert in said first insert.

6. A composite cap according to claim 1, wherein said attached seal comprises a resilient layer, the thickness of which is greater than 2 mm.

7. A composite cap according to claim 1, wherein said first insert has radial compression means which, without the formation of a fold, press the periphery of said attached seal on the periphery of the upper end of the glass ring.

8. A composite cap according to claim 1, wherein the composite cap has a longitudinal axis and said second portion comprises a lower end annulus and an upper end annulus connected together by longitudinal bridges, between which there extend flexible annular blades attached to said lower end annulus, oriented upwards and, at rest, inclined towards the longitudinal axis, so that the ends of said blades are situated on a circle the diameter of which is less than the outside diameter of the annular bead on the glass ring.

9. A composite cap according to claim 8, wherein said upper end annulus is provided with a bottom wall that forms a shoulder while extending as far as a diameter which is less than the diameter of the annular bead on the glass ring.

10. A glass ring, wherein the glass ring is part of a bottle having a neck with a top having a top rim level and wherein the glass ring occupies the top of the neck of the bottle and is adapted to accept a composite cap according to claim 1, wherein the glass ring comprises an annular bead situated at a distance from the top rim level with said first portion of said second insert as well as a circumferential immobilisation means cooperating with the circumferential immobilisation means of said second insert.

11. A glass ring according to claim 10, wherein the glass ring comprises a second annular bead serving as a stop for the pressing on of said composite cap.

12. A bottle useful for the staged consumption of drinks, wherein the bottle has a neck which is provided with a glass ring according to claim 10 and wherein the bottle is provided with a composite cap according to claim 1.

13. A method for capping a bottle adapted for the staged consumption of a drink, wherein the method comprises:

a) obtaining a bottle provided with a glass ring according to claim 10;

b) filling the bottle with said drink;

c) fixing a composite cap according to claim 1 to the glass ring of said bottle by simple axial translation.

* * * * *